US010500875B2

(12) United States Patent
Bouwens et al.

(10) Patent No.: US 10,500,875 B2
(45) Date of Patent: Dec. 10, 2019

(54) INKJET PRINTING METHOD FOR HEAT SENSITIVE SUBSTRATES

(71) Applicant: AGFA NV, Mortsel (BE)

(72) Inventors: Luc Bouwens, Mortsel (BE); Mark Barrett, Mortsel (BE); Joris Van Garsse, Mortsel (BE)

(73) Assignee: AGFA NV, Mortsel (BE)

( * ) Notice: Subject to any disclaimer, the term of this patent is extended or adjusted under 35 U.S.C. 154(b) by 0 days.

(21) Appl. No.: 15/770,766

(22) PCT Filed: Oct. 25, 2016

(86) PCT No.: PCT/EP2016/075600
§ 371 (c)(1),
(2) Date: Apr. 25, 2018

(87) PCT Pub. No.: WO2017/072088
PCT Pub. Date: May 4, 2017

(65) Prior Publication Data

US 2018/0326757 A1 Nov. 15, 2018

(30) Foreign Application Priority Data

Oct. 27, 2015 (EP) ..... 15191720

(51) Int. Cl.
*B41J 11/02* (2006.01)
*B41J 11/00* (2006.01)
(Continued)

(52) U.S. Cl.
CPC ..... *B41J 11/0085* (2013.01); *B41J 2/2117* (2013.01); *B41J 3/407* (2013.01); *B41J 3/4078* (2013.01); *B41J 11/002* (2013.01); *B41J 11/007* (2013.01); *B41J 11/06* (2013.01); *B65H 5/224* (2013.01)

(58) Field of Classification Search
CPC ..... B41J 3/407; B41J 11/002; B41J 11/0085; B41J 11/007; B41J 13/226; B41J 2/01; B41J 3/4078; B65H 5/224; B05C 5/00; B05D 5/00
See application file for complete search history.

(56) References Cited

U.S. PATENT DOCUMENTS 7,169,265 B1 1/2007 Kramer et al.
9,533,499 B2 * 1/2017 Davidson
(Continued)

FOREIGN PATENT DOCUMENTS

EP 2868604 A1 * 5/2015 ..... B41J 11/007

OTHER PUBLICATIONS

Official Communication issued in International Patent Application No. PCT/EP2016/075600, dated Dec. 12, 2016.

*Primary Examiner* — Huan H Tran
(74) *Attorney, Agent, or Firm* — Keating and Bennett, LLP

(57) ABSTRACT

An inkjet printing method using an inkjet printing device including a vacuum support for a substrate held down against a support surface of the vacuum support by air suction includes a step of jetting a set of layers with a set of liquids on the support surface to form a pattern with a surface roughness between 2.0 μm and 200.0 μm and rougher than the surface roughness of the support surface, and a step of supporting the substrate at least partially on the pattern.

16 Claims, 5 Drawing Sheets

(51) Int. Cl.

| | |
|---|---|
| ***B41J 3/407*** | (2006.01) |
| ***B41J 11/06*** | (2006.01) |
| ***B41J 2/21*** | (2006.01) |
| ***B65H 5/22*** | (2006.01) |

(56) References Cited

U.S. PATENT DOCUMENTS

| | | | |
|---|---|---|---|
| 2013/0074765 | A1 | 3/2013 | Heylen et al. |
| 2014/0087151 | A1 | 3/2014 | Davidson |

* cited by examiner

INKJET PRINTING METHOD FOR HEAT SENSITIVE SUBSTRATES

CROSS REFERENCE TO RELATED APPLICATIONS

This application is a 371 National Stage Application of PCT/EP2016/075600, filed Oct. 25, 2016. This application claims the benefit of European Application No. 15191720.0, filed Oct. 27, 2015, which is incorporated by reference herein in its entirety.

BACKGROUND OF THE INVENTION

1. Field of the Invention

The present invention relates to an inkjet printing device comprising a vacuum support for supporting a substrate, especially heat sensitive substrates, to print on by an inkjet printing method.

2. Description of the Related Art

Several inkjet printing device manufacturers sell moving gantry flatbed table inkjet printers wherein a substrate is loaded on a vacuum table, as vacuum support for the substrate, and a gantry, comprising a set of print heads, is moved above the loaded substrate. The set of print heads scans back-and-forth above the substrate while printing. Examples of such moving gantry flatbed table inkjet printers are FUJIFILM™ Acuity Advance Select X2, Agfa Graphics™: Jeti Mira and SwissQPrint™ Nyala 2.

Another method in the state-of-the-art flatbed table inkjet printing devices is moving a vacuum table, as vacuum support for the substrate, with the loaded substrate underneath a set of print-heads, comprised on a gantry. The set of print heads scans back-and-forth while printing such as Agfa Graphics™: Jeti 3020 Titan.

Inkjet printing devices with a vacuum belt, as vacuum support for the substrate, to transport a substrate underneath a print head are also well-known. Such inkjet printing devices currently are adapted for sign & display market with small sized substrates to much larger substrates or multiple substrates, printed at the same time, for industrial market; and special substrates such as manufacturing methods for glass, laminate floorings, carpets, textiles comprising inkjet printing methods. An example of such inkjet printing device is Agfa Graphics™: Jeti Tauro.

The several existing methods of flatbed table inkjet printing devices have all their own advantages such as accuracy, high volume production, versatility.

The state-of-the-art vacuum support inkjet printing devices comprise a vacuum support to support and to print a certain set of substrates but if another substrate needs special handling, such as cooling, another vacuum flatbed table inkjet printing device has to be used. The use of multiple inkjet printing devices makes it economically inefficient to fill daily all these inkjet printer devices with print-jobs and in an industrial environment 7-days-on-7 days. Each inkjet printing device in production need also separate calibration time and refurbishing time, whether or not, together with specific inkjet printing device knowledge. That is why there is a need for inkjet printing devices which are capable of using all kind of substrates to print-on so productivity becomes higher on the inkjet printing devices with less loss of service and calibration of the inkjet printing devices.

For printing on heat-sensitive substrates, the state-of-the-art vacuum support inkjet printing devices are capable of tuning the temperature of the vacuum table or the radiation of the dryers. But still most heat-sensitive substrates are difficult to be printed on these inkjet printing device. By lost in structural integrity of these heat-sensitive substrates it is difficult to hold-down the substrates against the vacuum support. Therefore there is a need of an inkjet printing device which may handle all kind of heat-sensitive substrates without tweaking and tuning of parameters from the inkjet printing device which influences the print quality on these kinds of substrates such as sharpness, adhesion on the substrate and wrinkles in the printed images and thus without admitting the print quality.

SUMMARY OF THE INVENTION

In order to overcome the problems described above, preferred embodiments of the present invention have been realised with an inkjet printing method as defined below.

Especially a vacuum support for an inkjet printing device (300) is adapted by jetting a pattern (102) or a plurality of patterns (102) on it for a better connection of a substrate (500) against the vacuum support to avoid collisions, by e.g. curling, crinkling or losing structural integrity of the substrate (500) by heat, to a print head (305) from the inkjet printing device (300).

In a nutshell the present invention comprises in a preferred embodiment the following consecutive steps in an algorithmic writing style:

a) Jetting a set of layers for forming a pattern (FIG. 2); and
b) Loading a substrate on the pattern (FIG. 4); and
c) Jetting an image on the substrate (FIG. 5); and
d) Unloading the printed substrate; and
e) Removing the pattern (FIG. 6).

Step a) of this preferred embodiment may be extended with drying the jetted set of layers.

Step c) of this preferred embodiment may be extended with drying the image.

This preferred embodiment, whether or not with the extensions of step a) and step c), may have extra steps after step e):

f) Jetting another set of layers for forming an other pattern; and
g) Loading another substrate on the other pattern; and
h) Jetting another image on the other substrate; and
i) Unloading the printed other substrate; and
j) Removing the other pattern.

Step f) may be extended with drying the jetted other set of layers.

Step h) may be extended with drying the another image

This preferred embodiment, whether or not with the extensions of step a) and step c) and whether or not with the extra steps f) to j) may have extra steps between step d) and step e):

d1) Loading a third substrate on the pattern; and
d2) Jetting a third image on the third substrate; and
d3) Unloading the printed third substrate.

Step d2) may be extended with drying the third image.

Further objects and details of the present invention will become apparent from the description hereinafter.

BRIEF DESCRIPTION OF THE DRAWINGS

FIGS. 1 to 6 illustrate a cross-cut of such inkjet printing device (300) which is not visible in these figures. The small channels in the vacuum table (100) are the suction holes.

FIG. 1 illustrates an initial status of the inkjet printing device (300).

In FIG. 2 the first step is illustrated: printing a pattern (102) on the vacuum table (100) by jetting a liquid via the left print head (305). The print head (305) moves above the vacuum table (100) with one or more print head (305) movements (350).

In FIG. 3 the second step is illustrated: using the suction holes by applying vacuum power, to make the suction holes in the vacuum table (100) free of jetted liquid. Meanwhile the jetted liquid on the vacuum table (100) is dried by a dryer (315). The surface roughness on the support surface of the vacuum table (100) is enhanced by the pattern (102). The dryer (315) moves above the vacuum table (100) with one or more print head (305) movements (350).

In FIG. 4 the third step is illustrated: loading a substrate (500) on the pattern (102) with higher surface roughness than the support surface of the vacuum table (100).

In FIG. 5 the fourth step is illustrated: Applying an image (502) by jetting an ink with the right print head (305) on the substrate (500) and drying the jetted ink by the dryer (315). The print head (305) and the dryer (315) moves above the vacuum table (100) with one or more print head (305) movements (350).

In FIG. 6 the fifth step is illustrated: peeling off the pattern (102) from the vacuum table (100) by hand after the printed substrate (500 together with 502) is unloaded.

DETAILED DESCRIPTION OF THE PREFERRED EMBODIMENTS

Figure 1:
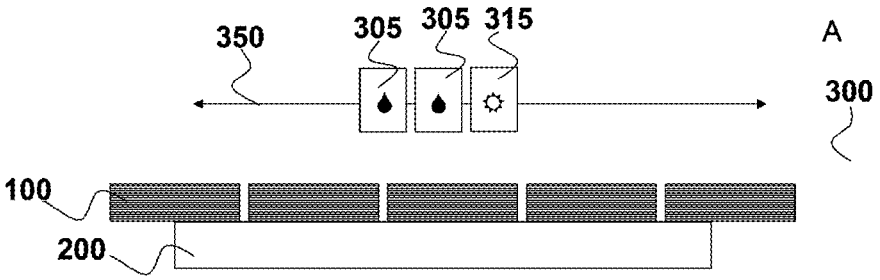
FIG. 1, FIG. 2, FIG. 3, FIG. 4, FIG. 5, FIG. 6 illustrate a sequence of steps (from A to F) according a preferred embodiment of the present invention on an inkjet printing device (300) with a vacuum table (100) as vacuum support where under a vacuum chamber (200) is attached to bring vacuum power on the support surface of the vacuum table (100).
Figure 2:
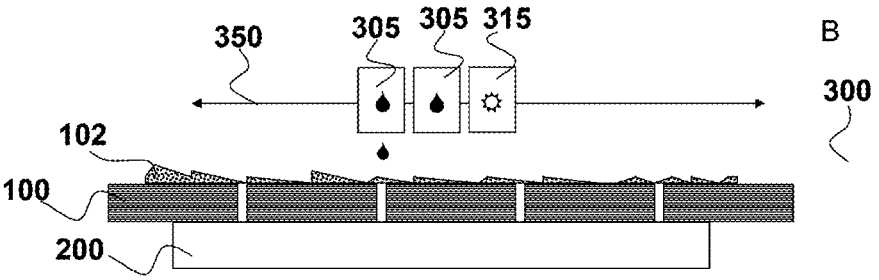
Figure 3:
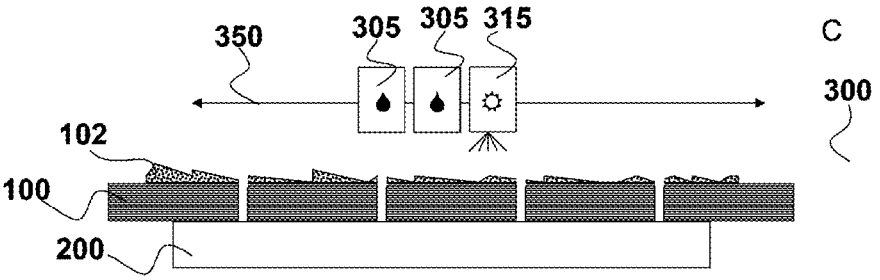
Figure 4:
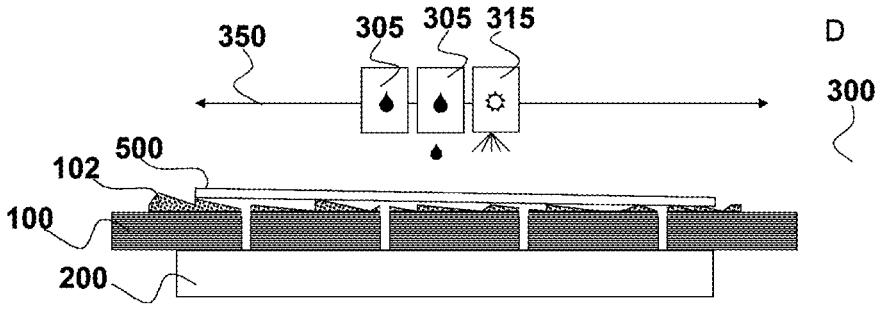

A preferred embodiment of the present invention is an inkjet printing method by an inkjet printing device (300) wherein the inkjet printing device (300) comprises a vacuum support for holding-down a substrate (500) against the support surface from the vacuum support by air suction; and wherein the inkjet printing method comprises: a step of jetting a set of layers by a set of liquids on the support surface to form a pattern (102) with a surface roughness between 2.0 μm and 200.0 μm and rougher than the surface roughness of the support surface; and a step of supporting the substrate (500) at least partially on the pattern (102). In a preferred embodiment the step of supporting the substrate (500) is partially on the pattern (102).

The surface roughness is preferably between 20.0 μm and 150 μm, and more preferably between 50.0 μm and 120 μm. The surface roughness of the support surface is between 0.001 μm and 100 μm, more preferably between 0.5 μm and 50 μm. The surface roughness of the pattern may be measured with a Dektak-8™ stylus profiler and contact-based 2D topography measurements. The geometry of the stylus is preferably 2.5 μm at 45 degrees and a stylus force 15 mg with a scan-resolution of 1.1 μm per sample. The processed option of the measurement is preferable X-flattening of Dektak™. The surface roughness means the average roughness, mostly accompanied with the symbol Ra or $R_a$. Surface roughness and methods to determine surface roughness are disclosed in Degarmo, E. Paul; Black, J.; Kohser, Ronald A. (2003), Materials and Processes in Manufacturing (9th ed.), Wiley, p. 223, ISBN 0-471-65653-4.

The pattern (102) is non-sticky else the pattern (102) may be stripped off when in contact with the substrate (500) while unloading the substrate (500); and else the back-side of the substrate (500) may be contaminated with the jetted set of layers.

The jetting of the pattern (102) is done on the inkjet printing device (300) itself and preferably the pattern (102) is easily removable from the support surface if another type of substrate (500) has to be supported and another pattern type is needed to support the other type of substrate (500). The adherence of the pattern (102) on the support surface and the set of layers have to be strong enough suitable to support (partially or whole) the substrate (500) while printing and, if needed, while drying and more preferably strong enough suitable to support (partially or whole) a plurality of consecutive substrates (500). It is an economically advantage when the pattern (102) may support consecutive substrates (500) so the jetting the pattern (102) has not to be redone.

It is found that by making regions in the support surface from a vacuum support rougher depending on the dimensions, size, shape and/or position on the vacuum support, the production of printed substrates can be enhanced. The hold down on the vacuum support is enforced where the substrate (500) is connected to the pattern (102). It is also found that the method is advantageous for heat-sensitive substrates. The amount of crinkling, dimensional changes, loosing structural integrity is minimized when such substrates are supported on the pattern (102) with higher roughness. In a preferred embodiment the supported substrate (500) inkjet printing method the substrate (500) is a heat-sensitive substrate which looses structural integrity above a temperature 35° C., more preferred above 60° C. The loss of structural integrity of a heat-sensitive substrate in a more preferred embodiment is between 35° C. and 300° C., most preferably between 40° C. and 90° C.

By roughening the support surface of the vacuum support the hold-down is improved with the same vacuum support but at also heat-sensitive substrates are less subjected to crinkling; dimensional changes and loss of structural integrity by the present invention. This is caused by continuous air passage through the roughened part of the support surface and air suction on the vacuum support in the roughened support surface by the jetted pattern (102).

In a preferred embodiment the set of layers is more than 2 so a higher surface roughness can be formed according the surface roughness of the support surface from the vacuum support.

By jetting the pattern (102) on a vacuum support the air channels in the vacuum support have to remain open so in a preferred embodiment the jetting of the step of layers is performed while adding a vacuum pressure via a plurality of vacuum apertures from the vacuum support. To prevent liquid debris in the vacuum chamber (200) connected to the vacuum support the interior means of the vacuum pump may comprises a filter, such as an air filter and/or coalescence filter and it may be connected to the vacuum pump connector. Preferably it is a coalescence filter, as filter, which is connected to the vacuum pump connector to split liquid and air from the contamination in the vacuum pump connector. WO2015067520 (AGFA GRAPHICS) discloses a preferred embodiment with such vacuum pump connector to split liquid and air.

The advantageous use of vacuum pressure is that no punching of suction holes on the vacuum support is needed.

Figure 5:
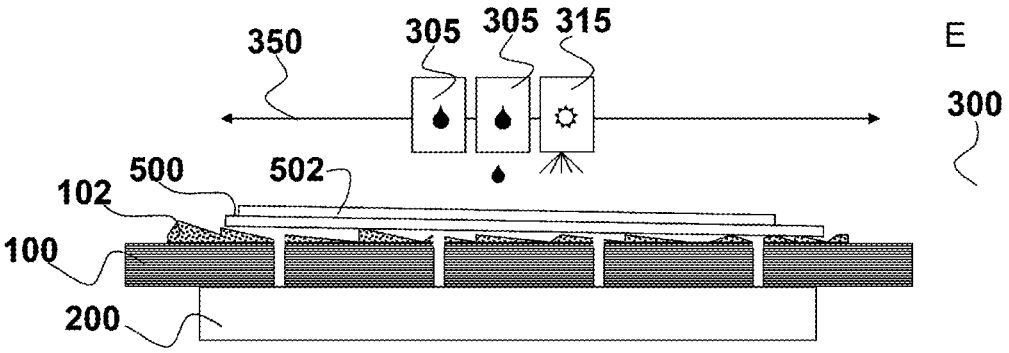
Figure 6:
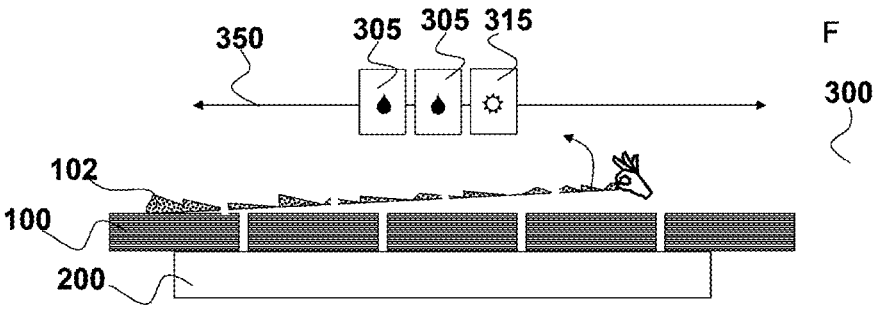
Figure 7:
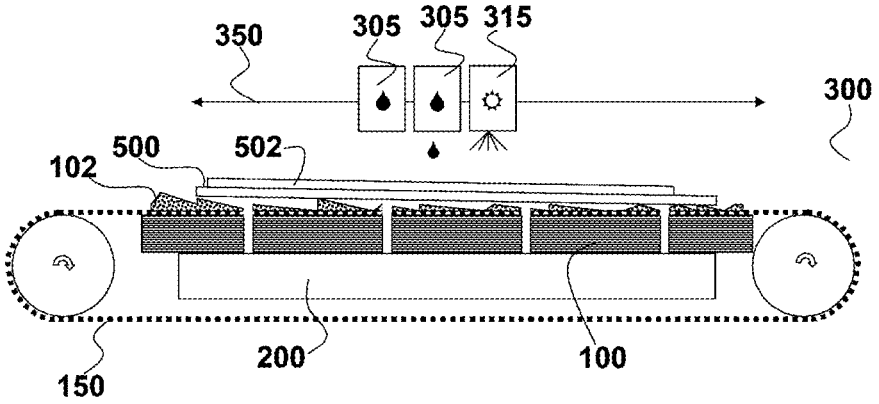
FIG. 7 illustrates another inkjet printing device (300) wherein a vacuum belt (150) is wrapped around the vacuum table (100). On the vacuum belt (150) the pattern (102) is jetted. The pattern (102) supports the substrate (500), similar as in FIG. 5.
Figure 8:
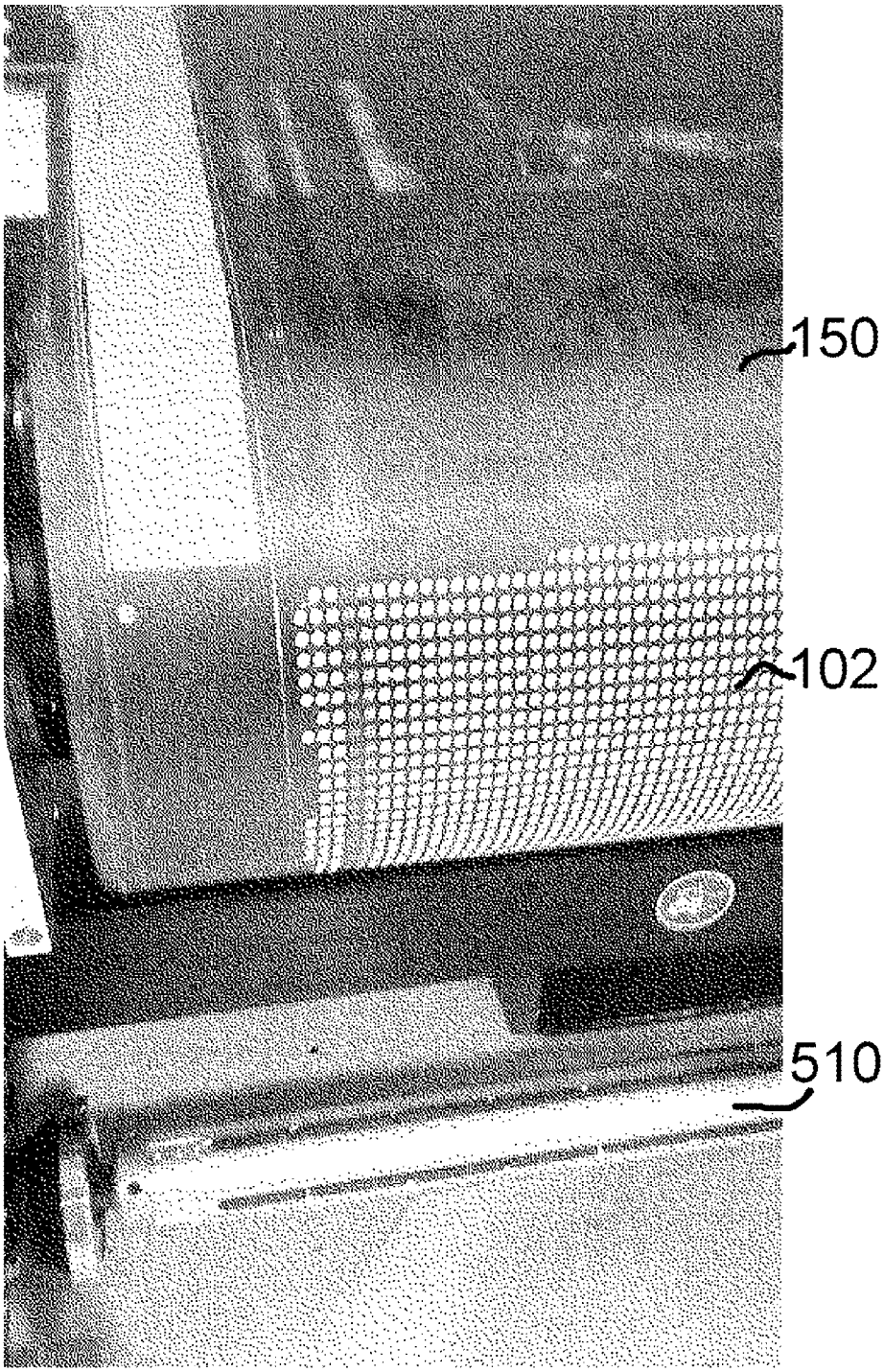
FIG. 8 is an image of Agfa Graphics™: Jeti Tauro at the front-side where a pattern (102) is jetted with the UV curable white ink of the Agfa Graphics™: Jeti Tauro on its vacuum belt (150) as in one of the preferred embodiments. The pattern (102) comprises a plurality of donut-shaped structures (=torus) in a lattice pattern which was advantageous to hold-down heat-sensitive substrates when supported on this pattern. The vacuum belt of Agfa Graphics™: Jeti Tauro itself has a surface roughness of 3.62 μm wherein the donut-shaped structures has a surface roughness more than 100 μm. The image visualizes also a shaft (510) for transporting substrates from roll to roll. The shaft is used to load the input roll of such substrates such as textile. The adhesion of the jetted pattern (102) was poor so it was easily removable by swiping it mechanically from the vacuum belt (150).
Figure 9:
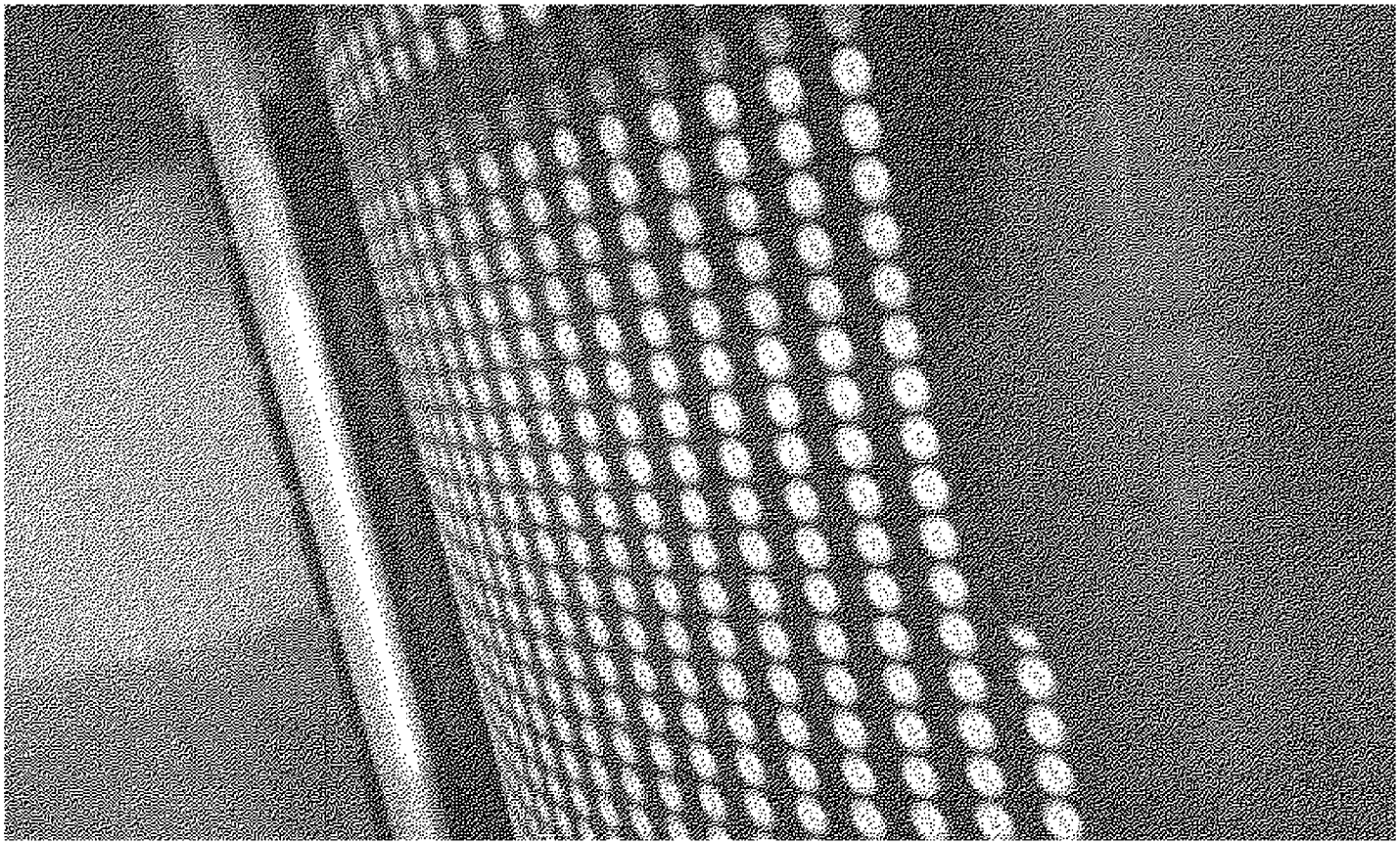
FIG. 9 is a detail of the image in FIG. 8 especially a detail of the pattern with plurality of donut shaped structures jetted with the UV curable white ink of the Agfa Graphics™: Jeti Tauro on its vacuum belt.

In a preferred embodiment the jetted pattern (102) may also be removed from the support surface so other patterns for other substrates (500) can be provided on the vacuum support. The preferred embodiment comprises the step, after inkjet printing the substrate (500) (FIG. 5): removing the pattern (102) from the vacuum support (FIG. 6). After the removing of the pattern another pattern may be jetted on the vacuum support to support another substrate. The position of the jetted pattern depends preferably where the substrate shall be loaded on the support surface of the vacuum support (100) so in a preferred embodiment the position on the support surface is determined first before jetting the pattern on the determined position. The determination may depend on the type of substrate, dimensions of substrate and/or weight of substrates. A database may be consulted to determine which kind of pattern has to be used for each type of substrate, dimensions of substrate and/or weight of substrates.

This preferred embodiment makes it possible to make your pattern (102) depending on the dimensions, positions, material and/or shape of the following substrates (500) that have to be printed. The type of pattern (102) can be changed depending on the material and/or weight of the substrate (500). The possibilities by jetting a pattern (102) to enhance the roughness may be chosen depending on the incoming substrate (500) which makes the inkjet printer device polyvalent to handle several types of substrates (500) and especially heat-sensitive substrates.

Several methods of removing a pattern (102) may be comprised in this removing step:

- swiping the pattern (102) mechanically off the vacuum support; and/or
- swiping the pattern (102) chemically off the vacuum support; and/or
- scratching the pattern (102) off the vacuum support; and/or
- peeling the pattern (102) off the vacuum support; (FIG. 6) and/or
- gumming the pattern (102) off the vacuum support; and/or
- burning the pattern (102) off the vacuum support.

The scratching of the pattern (102) may be done with a scratch off device whereon a brush is mounted, a kitchen scraper or a wide razor scraper.

An example for peeling (FIG. 6) the pattern (102) is by chemically soaking the pattern (102) so the backing of the pattern (102) is released from the vacuum support.

In a preferred embodiment the pattern (102) is jetted with one or more ink of the set of inks from the inkjet printing device (300). And in another preferred embodiment the pattern (102) is dried or cured with the dryer (315) comprised in the inkjet printing device (300) for drying the jetted inks from the set of inks on a substrate (500). In this preferred embodiment he inkjet printing device (300) comprises a dryer (315) and an set of inks; and wherein the inkjet printing method comprises the steps drying of the jetted set of layers by the dryer (315); and

- jetting an image with the set of inks on the substrate (500) after the step of supporting; and drying the image by the dryer (315) and more preferably the set of liquids is part of the set of inks.

The jetting viscosity of set of inks and/or set of liquids is between 25 mPa·s and 300 mPa·s.

It is found that well-formed patterns (102) can improve the holding down but also the cooling of heat-sensitive substrates so less curling, wrinkling occurs in the present invention. In a preferred embodiment the pattern (102) comprises a plurality of dried-and-jetted clusters to be well-formed; and wherein each dried-and-jetted cluster is formed by jetting and drying a plurality of droplets for example next to each other; and wherein each dried-and-jetted cluster has a surface area between 400 and 100000000 $\mu m^2$.

The pattern (102) is preferably a jetted halftone of a tone-value from 2% until 98% on the support surface of the vacuum support. The halftone is generated by a halftoning method such as error diffusion, amplitude modulation, frequency modulation and blue and green noise halftoning models. More information about halftoning methods is described in "Blue and green noise halftoning models", by LAU, D. L. and ULICHNEY, R in Signal Processing Magazine, IEEE (Volume: 20, Issue: 4), Pages 28-38 (DOI: 10.1109/MSP.2003.1215229) in July 2003. The images printed on substrates (500) by the inkjet printing device (300) are generated by a raster image processor (RIP), connected to this inkjet printing device (300). The halftoning method of the halftone in this preferred embodiment may also be generated in the same raster image processor (RIP).

In a preferred embodiment the jetted halftone is a halftone of a tone-value from 10% and 90% to have a higher surface roughness. Depending on the substrate (500) which has to be supported the tone-value may be changed and/or halftoning method may be changed depending on the heat sensitivity of the substrate (500). It is found that higher the heat sensitivity of the substrate (500), higher the surface roughness of the pattern (102) needs to be.

Another type of pattern (102) which is advantageous and comprised in a preferred embodiment is a lattice pattern with a thickness between 5 and 300 μm; or a pseudo-random pattern with a thickness between 5 and 300 μm. This preferred embodiment is combinable with the previous preferred embodiment to enhance the advantage even more.

The pattern (102) may also be a dimple pattern.

The pattern (102) may comprise a set of elements which has a shape selected from the list: a circle, ellipse, oval, rectangle, triangle, square, rectangle, pentagon, hexagon, heptagon, donut, octagon or any polygon containing at least three sides.

In a preferred embodiment the inkjet printing device (300) comprises a gantry whereon a print head (305) is coupled; and wherein the inkjet printing method comprises the step of moving (350) the vacuum support, parallel to the plane of the support surface, linear and relative to a gantry, underneath the print head (305) in a first direction to position the print head (305) above the substrate (500) and the support surface, more preferably comprises the step of moving the print head (305), parallel to the plane of the support surface from the vacuum support and perpendicular to the first direction, linear along the gantry for jetting on the substrate (500) and jetting on the support surface.

In another preferred embodiment the inkjet printing method is a single-pass inkjet printing device (300), comprising a print head module, which comprises a page-wide-print head and the liquid layer is formed by a page-wide-array print head and a set of unidirectional and/or bidirectional vacuum support movements.

Dimple

A dimple is a well-known term for structures on a golf-ball. It could be defined as an indentation made in a smooth surface. In the present invention the pattern (102) formed on the vacuum support, at its support surface, comprises a set of dimples. The vacuum support comprises in the present invention therefore a set of air-channels, which are connecting support surface and bottom surface of the vacuum support; and comprises, mostly underneath it, a vacuum chamber (200) which generates a vacuum pressure, by air suction, in the set of air-channels.

The dimple perimeter at the support surface of the vacuum support may be a circle, ellipse, oval, triangle, square, rectangle, pentagon, hexagon, heptagon, octagon, rhombus, rectangle, regular polygon or any polygon containing at least three sides. It may have at least one curved edge or non-linear edge. In accordance to another aspect of the invention, one or more sides of a polygonal dimple perimeter may be non-linear or curved. The advantage of a polygonal dimple perimeter is that more dimples with such dimple perimeter can be constructed on the top-surface of the vacuum support of the present invention.

A portion from the dimple indentation is preferably a spherical; polyhedron; substantially spherical or substantially polyhedron depression wherein the portion or the dimple indentation in it's entirely is preferably a concave indentation. The portion is preferably defined by a curved enclosure which is more preferably contained within the dimple perimeter at the support surface. The portion is preferably defined by a curved enclosure wherein the curved enclosure contacts all the sides of the dimple perimeter at the support surface or may contact one or more sides of the dimple perimeter at the support surface if the dimple perimeter is a polygon or a dimple perimeter which comprises a linear edge. The portion is preferably defined by a curved enclosure which is circular, oval or substantially circular.

Preferably a transitional surface connects the portion to the dimple perimeter. The transitional surface may be a flat surface, substantially flat surface or a curved surface, such as conical, cylindrical, spherical, parabolic or other shapes. The transition surface preferably blends the curvature of the portion to the border of the polygonal dimple perimeter.

The dimple perimeter at the support surface and the dimple indentation may be radially symmetric, i.e., the centre of the dimple perimeter and the centre of the portion and/or dimple indentation are proximate to each other. These two centres may also coincide to each other. Alternatively, the dimple perimeter and the dimple indentation may be radially asymmetric, i.e., the centre of the dimple perimeter and the centre of the portion and/or dimple indentation are offset from each other.

The area of a dimple perimeter is in the present invention preferably between 1 and 15 $mm^2$, more preferably between 2 and 8 $mm^2$, most preferably between 3 and 6 $mm^2$.

The volume of a dimple is in the present invention preferably between 1 and 30 $mm^3$, more preferably between 1.8 and 14.2 $mm^3$, most preferably between 2.7 and 8 $mm^3$.

The dimple indentation or a portion of the dimple indentation is preferably constructed in the present invention to minimize the de-vacuum-timing, to optimize the hold down of the substrate (500) before; while and after printing and/or to minimize the imprinting/deforming.

A dimple may comprise in its dimple indentation another dimple. This dimple shape is called a dimple-in-a-dimple shape.

Air-Cup

An air-cup is a dimple at the support surface of the vacuum support which is connected to an air-channel from the vacuum support, also called an vacuum-support-air-channel. In the present invention the pattern (102) formed on the vacuum support, at its support surface, comprises a set of air-cups. Air suction in this air-channel shall give rise to air suction in the dimple via this connection, also called air-cup connector. The air-cup has preferably a closed bottom end and more preferably the air-cup is sideward's connected to the air-channel. An air cup may have a set of air-cup connectors to the same air-channel and/or may have a set of air-cup connectors to a set of air-channels from the vacuum support. An air-cup may be connected to the air-channel via a set of air-cups and their air-cup connectors.

The dimple indentation or a portion of the dimple indentation from an air cup is preferably constructed to optimized optimal hold-down of substrates (500) against the vacuum support.

Dimple Pattern

In a preferred embodiment the formed pattern (102) by jetting an ink layer is a dimple pattern which is a set of dimples and more preferably a set of air-cups. The dimple pattern forms an air-sucking zone on the vacuum support via the roughness of the dimple pattern and in case of air-cups also via its air-channels. The dimple pattern is preferably formed regular and/or symmetrical more preferably the dimple pattern is a lattice pattern, which may have dimple rows and dimple columns at the support surface. A lattice pattern in a dimple pattern maybe a pattern with rhombic lattice, rectangular lattice, square lattice, hexagonal lattice, parallelogram lattice, equilateral triangular lattice or a honeycomb lattice of dimples.

In another preferred embodiment the dimple pattern (380) is a randomly arranged pattern or pseudo-randomly arranged pattern (102) and in a more preferred embodiment the dimple pattern is a blue noise pseudo-randomly arranged pattern.

In a preferred embodiment the distribution a dimple pattern is more than 2 dimples per $dm^2$, more preferably between 4 dimples per $dm^2$ and 400 dimples per $dm^2$, most preferably between 10 dimples per $dm^2$ and 200 dimples per $dm^2$.

If the dimple pattern is a lattice pattern with dimple rows and dimple columns, the density of dimples in a dimple row and/or dimple column is preferably more than 2 dimples per dm, more preferably between 1 dimple per dm and 20 dimples per dm, most preferably more than 30 dimples per dm.

The surface roughness of the dimple pattern may be measured with a Dektak-8™ stylus profiler and contact-based 2D topography measurements. The geometry of the stylus is preferably 2.5 μm at 45 degrees and a stylus force 15 mg with a scan-resolution of 1.1 μm per sample. The processed option of the measurement is preferable X-flattening of Dektak™.

Inkjet Printing Device (300)

An inkjet printing device (300), such as an inkjet printer, is a marking device that is using a print head (305) or a print head assembly with one or more print heads (305), which jets a liquid, as droplets or vaporized liquid, on a substrate (500). A marking that is marked by jetting of the inkjet printing device (300) on a substrate (500) is preferably an image. The pattern (102) may be achromatic or chromatic colour.

A preferred embodiment of the inkjet printing device (300) is that the inkjet printing device (300) is an inkjet printer and more preferably a wide-format inkjet printer. Wide-format inkjet printers are generally accepted to be any inkjet printer with a print width over 17 inches. Inkjet printers with a print width over the 100 inches are generally called super-wide printers or grand format printers. Wide-format printers are mostly used to print banners, posters, textiles and general signage and in some cases may be more economical than short-run methods such as screen printing. Wide format printers generally use a roll of substrate rather than individual sheets of substrate but today also wide format printers exist with a printing table whereon substrate (500) is loaded. A wide-format printer preferably comprises a belt step conveyor system.

A printing table, which may be vacuum table (100), in the inkjet printing device (300) may move under a print head (305) or a gantry may move a print head (305) over the printing table. These so called flat-table digital printers most often are used for the printing of planar substrates, ridged substrates and sheets of flexible substrates. They may incorporate IR-dryers or UV-dryers to prevent prints from sticking to each other as they are produced. An example of a wide-format printer and more specific a flat-table digital printer is disclosed in EP1881903 B (AGFA GRAPHICS NV).

The inkjet printing device (300) may perform a single pass printing method. In a single pass printing method the inkjet print heads (305) usually remain stationary and the substrate (500) is transported once under the one or more inkjet print heads (305). In a single pass printing method the method may be performed by using page wide inkjet print heads (305) or multiple staggered inkjet print heads (305) which cover the entire width of the substrate (500). An example of a single pass printing method is disclosed in EP2633998 (AGFA GRAPHICS NV). Such inkjet printing device (300) is also a called a single pass inkjet printing device (300).

The inkjet printing device (300) may mark a broad range of substrates (500) such as folding carton, acrylic plates, honeycomb board, corrugated board, foam, medium density fibreboard, solid board, rigid paper board, fluted core board, plastics, aluminium composite material, foam board, corrugated plastic, wood, carpet, textile, thin aluminium, paper, rubber, adhesives, vinyl, veneer, varnish blankets, wood, flexographic plates, metal based plates, fibreglass, plastic foils, glass sheet, mirrors, transparency foils, adhesive PVC sheets, impregnated paper and others. A substrate (500) may comprise an inkjet acceptance layer.

A substrate (500) may be a paper substrate or an impregnated paper substrate or a thermosetting resin impregnated paper substrate. Such thermosetting resin impregnated paper substrates are very brittle and heat-sensitive so also for these substrates the present invention is a benefit. An application of these thermosetting resin impregnated paper substrates includes decorative panels such as decorative laminates. In a preferred embodiment the present invention is comprised in the manufacturing of this application: a method for manufacturing decorative panels according to a preferred embodiment of the present invention includes the steps of: inkjet printing an image on a thermosetting resin impregnated paper substrate using an aqueous pigmented inkjet ink; heat pressing the printed thermosetting resin impregnated paper substrate into a decorative laminate; and cutting the laminate into a decorative panel. More information is disclosed in U.S. Pat. No. 8,196,366 (UNILIN). The core layer whereon the printed thermosetting resin impregnated paper substrate is heat-pressed is particle board, MDF (Medium Density Fibreboard) or HDF (High Density Fibreboard) or Oriented Strand Board (OSB).

For drying the marked substrate (500) an inkjet printing device (300) may comprises a dryer (315) to immobilize the jetted ink on the substrate (500). The dryer (315) preferably comprises an IR source and/or an UV source.

Preferably the inkjet printing device (300) comprises one or more print heads (305) jetting UV curable ink to mark substrate (500) and a UV source (=Ultra Violet source), as dryer (315), to cure the inks after marking. Spreading of a UV curable inkjet ink on a substrate (500) may be controlled by a partial curing or "pin curing" treatment wherein the ink droplet is "pinned", i.e. immobilized where after no further spreading occurs. For example, WO 2004/002746 (INCA) discloses an inkjet printing method of printing an area of a substrate (500) in a plurality of passes using curable ink, the method comprising depositing a first pass of ink on the area; partially curing ink deposited in the first pass; depositing a second pass of ink on the area; and fully curing the ink on the area.

A preferred configuration of UV source is a mercury vapour lamp. Within a quartz glass tube containing e.g. charged mercury, energy is added, and the mercury is vaporized and ionized. As a result of the vaporization and ionization, the high-energy free-for-all of mercury atoms, ions, and free electrons results in excited states of many of the mercury atoms and ions. As they settle back down to their ground state, radiation is emitted. By controlling the pressure that exists in the lamp, the wavelength of the radiation that is emitted can be somewhat accurately controlled, the goal being of course to ensure that much of the radiation that is emitted falls in the ultraviolet portion of the spectrum, and at wavelengths that will be effective for UV curable ink curing. Another preferred UV source is an UV-Light Emitting Diode, also called an UV-LED.

The inkjet printing device (300) may comprise an IR source (=Infra Red source) to solidify the ink by infra-red radiation. The IR source is preferably a NIR source (=Near Infra Red source) such as a NIR lamp. The IR source may comprise carbon infrared emitters which has a very short response time. An other IR source is a a SWIR (=Short Wave Infra Red source)

The IR source or UV source in the above preferred embodiments create a curing zone on the vacuum belt (150) to immobilize jetted ink on the substrate (500).

The inkjet printing device (300) may comprise corona discharge equipment to treating the substrate (500) before the substrate (500) passes a print head (305) of the inkjet printing device (300) because some substrates (500) have chemically inert and/or nonporous top-surfaces leading to a low surface energy which may result in bad print quality.

The embodiment of the printing method is preferably comprised in an industrial inkjet printing method such as a textile inkjet printing method.

Textile Inkjet Printing Device

Preferably the inkjet printing device (300) is a textile inkjet printing device, performing a textile inkjet printing method. The handling of such substrates on a vacuum support is difficult due to uncontrolled adhering of the substrate (500), mostly of the time a heat-sensitive substrate, against the vacuum support due to easy crinkle of the substrate (500) while transporting and/or heat upon the surface of the textile, for example in a hot print zone and/or hot curing zone This crinkle effect on the substrate (500) can not be hold down and hold flat on current vacuum supports so the substrate (500) may touch against a print head (305) from the inkjet printing device (300). Also crinkled textile is not acceptable for sale for example by bad print quality if the textile was not flat while printed. If no extra guiding means are implemented in the inkjet printing device (300) to hold down and flat the textile which introduces an extra manufacturing cost. For example in a hot printing area and/or hot curing area, if available, the crinkle effect of the textile can be become bigger. But in the present invention the connection, the hold-down and flat-down, of the substrate (500) with the vacuum support is guaranteed even in these hot printing area and/or curing area, if available, from the inkjet printing device (300). The textile is preferably pre-treated by corona treatment by corona discharge equipment because some textiles have chemically inert and nonporous surfaces leading to a low surface energy. Also some textiles also have issues with shrinkage which is avoided by the present invention by a good overall coupling of the textile on the vacuum support. This is a very high advantage for a textile inkjet printing device. Currently sticky conveyor belts are used to avoid this shrinkage issue on textiles but therefore the conveyor belts have to be applied regularly with glue but this is not needed with the present invention.

A textile in a textile inkjet printing device is a woven or non-woven textile. A textile is preferably selected from the group consisting of cotton textiles, silk textiles, flax textiles, jute textiles, hemp textiles, modal textiles, bamboo fibre textiles, pineapple fibre textiles, basalt fibre textiles, ramie textiles, polyester based textiles, acrylic based textiles, glass fibre textiles, aramid fibre textiles, polyurethane textiles, high density polyethylene textiles and mixtures thereof. The textile may be transparent, translucent or opaque.

A major advantage of the present invention is that printing can be performed on a wide range of textiles. Suitable textiles can be made from many materials. These materials come from four main sources: animal (e.g. wool, silk), plant (e.g. cotton, flax, jute), mineral (e.g. asbestos, glass fibre), and synthetic (e.g. nylon, polyester, acrylic). Depending on the type of material, it can be knitted, woven or non-woven textile.

The textile is preferably selected from the group consisting of cotton textiles, silk textiles, flax textiles, jute textiles, hemp textiles, modal textiles, bamboo fibre textiles, pineapple fibre textiles, basalt fibre textiles, ramie textiles, polyester based textiles, acrylic based textiles, glass fibre textiles, aramid fibre textiles, polyurethane textiles (e.g. Spandex or Lycra™), high density polyethylene textiles (Tyvek™) and mixtures thereof.

Suitable polyester textile includes polyethylene terephthalate textile, cation dyeable polyester textile, acetate textile, diacetate textile, triacetate textile, polylactic acid textile and the like.

Applications of these textiles include automotive textiles, canvas, banners, flags, interior decoration, clothing, swimwear, sportswear, ties, scarves, hats, floor mats, doormats, carpets, mattresses, mattress covers, linings, sacking, upholstery, carpets, curtains, draperies, sheets, pillowcases, flame-retardant and protective fabrics, and the like. In a preferred embodiment the present invention is comprised in the manufacturing of one of these applications. Polyester fibre is used in all types of clothing, either alone or blended with fibres such as cotton. Aramid fibre (e.g. Twaron) is used for flame-retardant clothing, cut-protection, and armour. Acrylic is a fibre used to imitate wools.

It is found that in the present invention the jetted ink or liquid penetrates easier in the fibres of a textile.

Leather Inkjet Printing Device

Preferably the inkjet printing device (300) is a leather inkjet printing device, performing a leather inkjet printing method. The handling of such heat-sensitive substrates on a vacuum support is difficult due to uncontrolled adhering of the substrate (500) against the vacuum support due to easy crinkle of the substrate (500) while transporting and/or heat upon the surface of the leather, for example in a hot print zone and/or hot curing zone This crinkle effect on the substrate (500) can not be hold down and hold flat on current vacuum supports so the substrate (500) may touch against a print head (305) from the inkjet printing device (300). Also crinkled leather is not acceptable for sale for example by bad print quality if the leather was not flat while printed. If no extra guiding means are implemented in the inkjet printing device (300) to hold down and flat the leather which introduces an extra manufacturing cost. For example in a hot printing area and/or hot curing area, if available, the crinkle effect of the leather can be become bigger. But in the present invention the connection, the hold-down and flat-down, of the substrate (500) with the vacuum support is guaranteed even in these hot printing area and/or curing area, if available, from the inkjet printing device (300).

The leather is preferably pre-treated by corona treatment by corona discharge equipment because some leathers, such as artificial leathers; have chemically inert and nonporous surfaces leading to a low surface energy. Also some leathers also have issues with shrinkage which is avoided by the present invention by a good overall coupling of the leather on the vacuum support. This is a very high advantage for a leather inkjet printing device. Artificial leather is a fabric intended to substitute leather in fields such as upholstery, clothing, and fabrics, and other uses where a leather-like finish is required but the actual material is cost-prohibitive, unsuitable, or unusable for ethical reasons.

Artificial leather is marketed under many names, including "leatherette", "faux leather", and "pleather". Suitable artificial leather includes poromeric imitation leather, corfam, koskin and leatherette. Suitable commercial brands include Biothane™ from BioThane Coated Webbing, Birkibuc™ and Birko-Flor™ from Birkenstock, Kydex™ from Kleerdex, Lorica™ from Lorica Sud, and Fabrikoid™ from DuPont.

Applications of these leathers include upholstery, clothing, shoes and the like. In a preferred embodiment the present invention is comprised in the manufacturing of one of these applications.

Similar as printing on leather: The heat-sensitive substrate is preferably a thermoplastic foil, more preferably a thermoplastic foil selected from the groups consisting of polyvinyl chloride (PVC), polyolefins like polyethylene (PE) and polypropylene (PP), polyamides (PA), polyurethane (PU), polystyrene (PS), acrylonitrile-butadiene-styrene (ABS), polymethyl methacrylate (PMMA), polycarbonate (PC), polyethylene terephthalate (PET), polyetheretherketone (PEEK) or mixtures or co-polymers of these. An application of these thermoplastic foils includes polymeric decorative panels. In a preferred embodiment the present invention is comprised in the manufacturing of this application: a method for manufacturing polymeric decorative panels according to a preferred embodiment of the present invention includes the steps of: inkjet printing an image on a thermoplastic foil using an aqueous pigmented inkjet ink; applying a second thermoplastic foil on the inkjet printed image; heat pressing the first and second thermoplastic foils into a decorative laminate; and cutting the laminate into a decorative panel.

Plastic Foil Inkjet Printing Device

Preferably the inkjet printing device (300) is a plastic foil inkjet printing device, performing a plastic foil inkjet printing method. The substrate (500) of such inkjet printing device (300) is always plastic foil, such as polyvinyl chloride (PVC), polyethylene (PE), low density polyethylene (LDPE), polyvinylidene chloride (PVdC). The thickness of a plastic foil is preferably between 30 and 200 μm, more preferably between 50 and 100 μm and most preferably between 60 to 80 μm. In a preferred embodiment the plastic foil is suitable for making plastic bags. Plastic foils are generally heat-sensitive substrates.

The handling of such substrates (500) on a vacuum support is difficult due to uncontrolled adhering of the substrate (500) against the vacuum support due to easy crinkle of the substrate (500) while transporting and/or heat upon the surface of the plastic foil, for example in a hot print zone and/or hot curing zone This crinkle effect on the substrate (500) can not be hold down and hold flat on current vacuum supports so the substrate (500) may touch against a print head (305) from the inkjet printing device (300). Also crinkled plastic foil is not acceptable for sale for example by bad print quality if the plastic foil was not flat while printed. If no extra guiding means are implemented in the inkjet printing device (300) to hold down and flat the plastic foil which introduces an extra manufacturing cost. For example in a hot printing area and/or hot curing area, if available, the crinkle effect of the plastic foil can be become bigger. But in the present invention the connection, the hold-down and flat-down, of the substrate (500) with the vacuum support is guaranteed even in these hot printing area and/or curing area, if available, from the inkjet printing device (300). The plastic foil is preferably pre-treated by corona treatment by corona discharge equipment because most plastics, such as polyethylene and polypropylene, have chemically inert and nonporous surfaces leading to a low surface energy.

Corona Discharge Equipment

Corona discharge equipment consists of a high-frequency power generator, a high-voltage transformer, a stationary electrode, and a treater ground roll. Standard utility electrical power is converted into higher frequency power which is then supplied to the treater station. The treater station applies this power through ceramic or metal electrodes over an air gap onto the material's surface.

A corona treatment can be applied in the present invention to unprimed substrates, but also to primed substrates.

Vacuum Chamber (200)

A vacuum chamber (200) is a rigid enclosure which is constructed by many materials preferably it may comprise a metal. The choice of the material is based on the strength, pressure and the permeability. The material of the vacuum chamber (200) may comprise stainless steel, aluminium, mild steel, brass, high density ceramic, glass or acrylic.

A vacuum pump provides a vacuum pressure inside a vacuum chamber (200) and is connected by a vacuum pump connector, such as a tube, to a vacuum pump input such as aperture in the vacuum chamber (200). Between the vacuum pump connector a vacuum controller, such as a valve or a tap, may be provided to control the vacuum in a sub-vacuum chamber wherein the aperture is positioned.

To prevent contamination, such as paper dust, substrate fibers, ink, ink residues and/or ink debris such as cured ink, to contaminate via the set of air-channels of the vacuum support and/or the set of vacuum-belt-air-channels from the vacuum support the interior means of the vacuum pump, a filter, such as an air filter and/or coalescence filter, may be connected to the vacuum pump connector. Preferably a coalescence filter, as filter, is connected to the vacuum pump connector to split liquid and air from the contamination in the vacuum pump connector.

Vacuum Table (100)

A vacuum table (100) is a vacuum support. A vacuum chamber (200), comprised in an inkjet printing device (300), hold-downs the substrate (500) for fixing the substrate (500) against the vacuum table (100).

To avoid registration problems while printing on a substrate (500) and to avoid collisions while conveying a substrate (500), the substrate (500) needs to be connected to a support, also called a printing table. A vacuum table (100) is a printing table wherein the substrate (500) is connected to the printing table by vacuum pressure. A vacuum table (100) is also called a porous printing table. Between the substrate (500) and the vacuum table (100) may be a vacuum belt (150) when a vacuum belt (150) is wrapped around the vacuum table (100).

Preferably the vacuum table (100) in the embodiment comprises a set of air-channels to provide a pressure differential by a vacuum chamber (200) at the support layer of the vacuum table (100) to create a vacuum zone and at the bottom-surface of the printing table a set of apertures which are connected to the set of air-channels. These apertures at the bottom layer may be circular, elliptical, square, rectangular shaped and/or grooves, such as slits, parallel with the bottom layer of the vacuum table (100).

The width or height of the vacuum table (100) is preferably from 1.0 m until 10 m. The larger the width and/or height, the larger the substrate (500) may be supported by the vacuum table (100) which is an economical benefit.

An aperture at the bottom-surface and at the support surface of the vacuum table (100) may be connected to one or more air-channels. An aperture at the bottom-surface or support surface of the vacuum table (100) may be small in size, preferably from 0.3 to 12 mm in diameter, more preferably from 0.4 to 8 mm in diameter, most preferably from 0.5 to 5 mm in diameter and preferably spaced evenly apart on the vacuum support preferably 1 mm to 50 mm apart, more preferably from 4 to 30 mm apart and most preferably from 5 to 15 mm apart to enable the creation of uniform vacuum pressure that connects a substrate (500) together with the vacuum table (100).

A set of apertures at the support layer of the vacuum table (100) may be connected to the air-channels. These apertures at the support layer may be circular, elliptical, square, rectangular shaped and/or grooves, such as slits, parallel with the support layer of the vacuum table (100). Preferably, if the apertures are grooves, the grooves are oriented along the printing direction of the inkjet printing device (300).

Preferably the vacuum table (100) of the embodiment comprising a honeycomb structure plate which is sandwiched between a top and bottom sandwich plate which comprises each a set of apertures connect to one or more air-channels in the vacuum table (100). The honeycomb cores, as part of the air-channels, in the honeycomb structure plate results in a better uniform vacuum distribution on the support surface of the vacuum table (100).

The dimensions and the amount of air-channels should be sized and frequently positioned to provide sufficient vacuum pressure to the vacuum table (100). Also the dimensions and the amount of apertures at the bottom-surface of the vacuum table (100) should be sized and frequently positioned to provide sufficient vacuum pressure to the vacuum table (100). The dimension between two air-channels or two apertures at the bottom-surface of the vacuum table (100) may be different. A honeycomb core is preferably sinusoidal or hexagonal shaped.

If a honeycomb structure plate is comprised in the vacuum table (100) also the dimensions and the amount of honeycomb cores should be sized and frequently positioned to provide sufficient vacuum pressure to the vacuum table (100). The dimensions between two neighbour honeycomb cores may be different.

The support layer of the printing table should be constructed to prevent damaging of a substrate (500) or vacuum support if applicable. For example the apertures at the support layer that are connected with the air-channels may have rounded edges. The support layer of the printing table may be configured to have low frictional specifications.

The vacuum table (100) is preferably parallel to the ground whereon the inkjet printing system is connected to avoid misaligned printed images.

The vacuum pressure in a vacuum zone on the support surface of the vacuum table (100) may couple the substrate (500) and the vacuum table (100) by sandwiching the vacuum belt (150) that carries the substrate (500). The coupling is preferably done while printing to hold down the substrate (500) to avoid bad alignment and color-on-color register problems. The vacuum pressure in a vacuum zone on the support surface of the vacuum table (100) may apply sufficient normal force to the vacuum support when the vacuum support is moving and carrying a substrate (500) in the conveying direction. The vacuum pressure may also prevent any fluttering and/or vibrating of the vacuum support or substrate (500) on the vacuum support. The vacuum pressure in a vacuum zone may be adapted while printing.

The top-surface, also called the support surface, of the vacuum table (100) or a portion of the vacuum table (100), such as the inner side of its air-channels may be coated to have easy cleaning performances e.g. as result of dust or ink leaks. The coating is preferably a dust repellent and/or ink repellent and/or hydrophobic coating. Preferably the top-surface of the vacuum table (100) or a portion of the vacuum table (100), such as the inner side of its air-channels, is treated with an ink repelling hydrophobic method by creating a lubricious and repelling surface which reduces friction.

Vacuum-Support-Air-Channel

A vacuum-support-air-channel is an air-channel from the support surface to the bottom surface of the vacuum support. It is also called a suction-hole if the perimeter of the vacuum-support-air-channel at the support surface is substantially circular.

The area of a vacuum-support-air-channel at the support surface of the vacuum support is in the present invention preferably between 0.3 $mm^2$ and 5 $mm^2$. More preferably the perimeter of the vacuum-support-air-channel at the support surface has the same shape as a circle, ellipse, oval, rectangle, triangle, square, rectangle, pentagon, hexagon, heptagon, octagon or any polygon containing at least three sides.

The vacuum-support-air-channel is preferably tapered in the direction of the bottom surface for optimal vacuum pressure effect at the support surface.

The distribution of air-channels on the support surface of the vacuum support is preferably between 1 air-channel per dm2 and 100 air-channels per $dm^2$; more preferably between 5 air-channels per $dm^2$ and 50 per $dm^2$.

The perimeter of a suction-hole is preferably from 0.3 to 10 mm in diameter, more preferably from 0.4 to 5 mm in diameter, most preferably from 0.5 to 2 mm in diameter The vacuum-belt-air-channels in the air-sucking zone (105) are preferably spaced evenly apart on the vacuum support preferably 3 mm to 50 mm apart, more preferably from 4 to 30 mm apart and most preferably from 5 to 15 mm apart to enable the creation of uniform vacuum pressure that holds the substrate (500) together with the vacuum support. Smaller the apertures in the vacuum support, higher the vacuum pressure at the top of the vacuum support.

Vacuum Belt (150)

A vacuum belt (150) is a vacuum support. A vacuum belt (150), comprised in an inkjet printing device (300), transports a substrate (500) for printing and hold-downs the substrate (500) for fixing the substrate (500) against the vacuum belt (150).

Preferably the vacuum belt (150) has two or more layers of materials wherein an under layer provides linear strength and shape, also called the carcass and an upper layer called the cover or the support side. The carcass is preferably a woven fabric web and more preferably a woven fabric web of polyester, nylon, glass fabric or cotton. The material of the cover is preferably various rubber and more preferably plastic compounds and most preferably thermoplastic polymer resins. But also other exotic materials for the cover can be used such as silicone or gum rubber when traction is essential. An example of a multi-layered conveyor belt for a general belt conveyor system wherein the cover having a gel coating is disclosed in US 20090098385 A1 (FORBO SIEBLING GMBH).

Preferably the vacuum belt (150) comprises glass fabric or the carcass is glass fabric and more preferably the glass fabric, as carcass, has a coated layer on top comprising a thermoplastic polymer resin and most preferably the glass fabric has a coated layer on top comprising polyethylene terephthalate (PET), polyamide (PA), high-density polyethylene (HDPE), polytetrafluoroethylene (PTFE), polyoxymethylene (POM), polyurethaan (PU) and/or Polyaryletherketone (PAEK). The coated layer may also comprise aliphatic polyamides, polyamide 11 (PA 11), polyamide 12 (PA 12), UHM-HDPE, HM-HDPE, Polypropylene (PP), Polyvinyl chloride (PVC), Polysulfone (PS), Poly(p-phenylene oxide) (PPO™), Polybutylene terephthalate (PBT), Polycarbonate (PC), Polyphenylene sulphide (PPS).

Preferably the vacuum belt (150) is and endless vacuum belt (150). Examples and figures for manufacturing an endless multi-layered Vacuum belt (150) for a general belt conveyor system are disclosed in EP 1669635 B (FORBO SIEBLING GMBH).

The top-surface of the vacuum belt (150) or a portion of the vacuum belt (150), such as its air-channels, may be coated to have easy cleaning as result of e.g. dust or ink leaks. The coating is preferably a dust repellent and/or ink repellent and/or hydrophobic coating. Preferably the top-surface of the vacuum belt (150) or a portion of the vacuum, belt is treated with an ink repelling hydrophobic method by creating a lubricious and repelling surface which reduces friction.

A layer of neutral fibres in the vacuum belt (150) is preferably constructed at a distance from the bottom surface between 2 mm and 0.1 mm, more preferably between 1 mm and 0.3 mm. This layer with neutral fibres is of big importance to have a straight conveying direction with minimal side force on the vacuum belt (150) and/or minimized fluctuation of the Pitch Line of the vacuum belt (150) for high printing precision transportation.

The top surface, also called the support surface, of the vacuum belt (150) comprises preferable hard urethane with a preferred thickness (measured from top surface to bottom surface) between 0.2 to 5.5 mm. The total thickness (measured from top surface to bottom surface (108)) of the vacuum belt (150) is preferably between 1.2 to 7 mm. The top-surface is preferably high resistance to solvents so the inkjet printing device (300) is useful in an industrial printing and/or manufacturing environment.

Print Head (305)

A print head (305) is a means for jetting a liquid on a substrate (500) through a nozzle. The nozzle may be comprised in a nozzle plate which is attached to the print head (305). A print head (305) preferably has a plurality of nozzles which may be comprised in a nozzle plate. A set of liquid channels, comprised in the print head (305), corresponds to a nozzle of the print head (305) which means that the liquid in the set of liquid channels can leave the corresponding nozzle in the jetting method. The liquid is preferably an ink, more preferably an UV curable inkjet ink or water based inkjet ink, such as a water based resin inkjet ink. The liquid used to jet by a print head (305) is also called a jettable liquid. A high viscosity jetting method with UV curable inkjet ink is called a high viscosity UV curable jetting method. A high viscosity jetting method with water based inkjet ink is called a high viscosity water base jetting method.

The way to incorporate print heads (305) into an inkjet printing device (300) is well-known to the skilled person.

A print head (305) may be any type of print head (305) such as a Valvejet print head, piezoelectric print head, thermal print head (305), a continuous print head (305) type, electrostatic drop on demand print head (305) type or acoustic drop on demand print head (305) type or a page-wide print head (305) array, also called a page-wide inkjet array.

A print head (305) comprises a set of master inlets to provide the print head (305) with a liquid from a set of external liquid feeding units. Preferably the print head (305) comprises a set of master outlets to perform a recirculation of the liquid through the print head (305). The recirculation may be done before the droplet forming means but it is more preferred that the recirculation is done in the print head (305) itself, so called through-flow print heads (305). The continuous flow of the liquid in a through-flow print heads (305) removes air bubbles and agglomerated particles from the liquid channels of the print head (305), thereby avoiding blocked nozzles that prevent jetting of the liquid. The continuous flow prevents sedimentation and ensures a consistent jetting temperature and jetting viscosity. It also facilitates auto-recovery of blocked nozzles which minimizes liquid and receiver wastage.

The number of master inlets in the set of master inlets is preferably from 1 to 12 master inlets, more preferably from 1 to 6 master inlets and most preferably from 1 to 4 master inlets. The set of liquid channels that corresponds to the nozzle are replenished via one or more master inlets of the set of master inlets.

The amount of master outlets in the set of master outlets in a through-flow print head (305) is preferably from 1 to 12 master outlets, more preferably from 1 to 6 master outlets and most preferably from 1 to 4 master outlets.

In a preferred embodiment prior to the replenishing of a set of liquid channels, a set of liquids is mixed to a jettable liquid that replenishes the set of liquid channels. The mixing to a jettable liquid is preferably performed by a mixing means, also called a mixer, preferably comprised in the print head (305) wherein the mixing means is attached to the set of master inlets and the set of liquid channels. The mixing means may comprise a stirring device in a liquid container, such as a manifold in the print head (305), wherein the set of liquids are mixed by a mixer. The mixing to a jettable liquid also means the dilution of liquids to a jettable liquid. The late mixing of a set of liquids for jettable liquid has the benefit that sedimentation can be avoided for jettable liquids of limited dispersion stability.

The liquid leaves the liquid channels by a droplet forming means, through the nozzle that corresponds to the liquid channels. The droplet forming means are comprised in the print head (305). The droplet forming means are activating the liquid channels to move the liquid out the print head (305) through the nozzle that corresponds to the liquid channels.

The amount of liquid channels in the set of liquid channels that corresponds to a nozzle is preferably from 1 to 12, more preferably from 1 to 6 and most preferably from 1 to 4 liquid channels.

The print head (305) of the present invention is preferably suitable for jetting a liquid having a jetting viscosity of 8 mPa·s to 3000 mPa·s. A preferred print head (305) is suitable for jetting a liquid having a jetting viscosity of 20 mPa·s to 200 mPa·s; and more preferably suitable for jetting a liquid having a jetting viscosity of 50 mPa·s to 150 mPa·s.

Belt Step Conveyor System

In a preferred embodiment the inkjet printing device (300) comprises a vacuum belt (150), wrapped around the vacuum table (100), wherein the vacuum belt (150) carries a substrate (500) by moving from a start location to an end location in preferably successive distance movements also called discrete step increments. This is also called a belt step conveyor system.

The belt step conveyor system may be driven by an electric stepper motor to produce a torque to a pulley so by friction of the vacuum belt (150) on the powered pulley the vacuum belt (150) and the substrate (500) is moved in a conveying direction. The use of an electric stepper motor makes the transport of a load more controllable e.g. to change the speed of conveying and move the load on the vacuum belt (150) in successive distance movements. An example of a belt step conveying belt system with an electric stepper motor is described for the media transport of a wide-format printer in EP 1235690 A (ENCAD INC)

To known the distance of the successive distance movements in a belt step conveyor system, that is driven by an electric stepper motor to produce a torque to a pulley so by friction of the vacuum belt (150) on the powered pulley the vacuum belt (150) and the substrate (500) is moved in a conveying direction substrate (500) on the vacuum belt (150), so it can be communicated to other controllers such as a renderer of the inkjet printing device (300) or the controllers of a inkjet head, an encoder is comprised on one of the pulleys that are linked with the vacuum belt (150)

But preferably the encoder measures the linear feed of the vacuum belt (150) directly on the vacuum belt (150) by a measuring device comprising a position sensor that may attachable to the vacuum belt (150) and a stationary reference means wherein the relative position of the position sensor to the stationary reference means is detected. The position sensor comprises preferably an optical sensor which may interpret the distance between the position sensor and the stationary reference means on a distance ruler, such as an encoder strip, which is preferably comprised at the stationary reference means. Preferably the measuring device comprises a gripper to grip the position sensor to the conveying belt. The measuring device may comprising a guide means through which the position sensor relative to the stationary reference means is guided—preferably linear. By attaching the position sensor to the vacuum belt (150) while moving the vacuum belt (150) in a conveying direction, the distance can be measured between the position sensor and the stationary reference means. Between the discrete steps increments the position sensor may release the vacuum belt (150) and may return to the stationary reference.

To enhance the accuracy of this measuring device the vacuum table (100) which may provide a set of vacuum zones, preferably related to a sub-vacuum chamber (200) that is created by a moving vacuum divider, at an edge of the vacuum belt (150) to correct the flatness, resilience, oblique movement correction, position of the vacuum belt (150) on the pulleys and/or the tension of the vacuum belt (150) by applying a different vacuum pressure in the vacuum zone at the edge of the vacuum belt (150).

Piezoelectric Print Heads

Another preferred print head (305) for the present invention is a piezoelectric print head. piezoelectric print head, also called piezoelectric inkjet print head, is based on the movement of a piezoelectric ceramic transducer, comprised in the print head, when a voltage is applied thereto. The application of a voltage changes the shape of the piezoelectric ceramic transducer to create a void in a liquid channel, which is then filled with liquid. When the voltage is again removed, the ceramic expands to its original shape, ejecting a droplet of liquid from the liquid channel.

The droplet forming means of a piezoelectric print head controls a set of piezoelectric ceramic transducers to apply a voltage to change the shape of a piezoelectric ceramic transducer. The droplet forming means may be a squeeze mode actuator, a bend mode actuator, a push mode actuator or a shear mode actuator or another type of piezoelectric actuator.

Suitable commercial piezoelectric print heads are TOSHIBA TEC™ CK1 and CK1L from TOSHIBA TEC™ (https://www.toshibatec.co.jp/en/products/industrial/inkjet/prod ucts/cf1/) and XAAR™ 1002 from XAAR™ (http://www.xaar.com/en/products/xaar-1002).

A liquid channel in a piezoelectric print head is also called a pressure chamber.

Between a liquid channel and a master inlet of the piezoelectric print heads, there is a manifold connected to store the liquid to supply to the set of liquid channels.

The piezoelectric print head is preferably a through-flow piezoelectric print head. In a preferred embodiment the recirculation of the liquid in a through-flow piezoelectric print head flows between a set of liquid channels and the inlet of the nozzle wherein the set of liquid channels corresponds to the nozzle.

In a preferred embodiment in a piezoelectric print head the minimum drop size of one single jetted droplet is from 0.1 pL to 300 pL, in a more preferred embodiment the minimum drop size is from 1 pL to 30 pL, in a most preferred embodiment the minimum drop size is from 1.5 pL to 15 pL. By using grayscale inkjet head technology multiple single droplets may form larger drop sizes.

In a preferred embodiment the piezoelectric print head has a drop velocity from 3 meters per second to 15 meters per second, in a more preferred embodiment the drop velocity is from 5 meters per second to 10 meters per second, in a most preferred embodiment the drop velocity is from 6 meters per second to 8 meters per second.

In a preferred embodiment the piezoelectric print head has a native print resolution from 25 DPI to 2400 DPI, in a more preferred embodiment the piezoelectric print head has a native print resolution from 50 DPI to 2400 DPI and in a most preferred embodiment the piezoelectric print head has a native print resolution from 150 DPI to 3600 DPI.

In a preferred embodiment with the piezoelectric print head the jetting viscosity is from 8 mPa·s to 200 mPa·s more preferably from 25 mPa·s to 100 mPa·s and most preferably from 30 mPa·s to 70 mPa·s.

In a preferred embodiment with the piezoelectric print head the jetting temperature is from 10° C. to 100° C. more preferably from 20° C. to 60° C. and most preferably from 30° C. to 50° C.

The nozzle spacing distance of the nozzle row in a piezoelectric print head is preferably from 10 μm to 200 μm; more preferably from 10 μm to 85 μm; and most preferably from 10 μm to 45 μm.

Inkjet Ink

In a preferred embodiment, the liquid in the print head (305) is an aqueous curable inkjet ink, and in a most preferred embodiment the inkjet ink is an UV curable inkjet ink.

A preferred aqueous curable inkjet ink includes an aqueous medium and polymer nanoparticles charged with a polymerizable compound. The polymerizable compound is preferably selected from the group consisting of a monomer, an oligomer, a polymerizable photoinitiator, and a polymerizable co-initiator.

An inkjet ink may be a colourless inkjet ink and be used, for example, as a primer to improve adhesion or as a varnish to obtain the desired gloss. However, preferably the inkjet ink includes at least one colorant, more preferably a colour pigment. The inkjet ink may be a cyan, magenta, yellow, black, red, green, blue, orange or a spot color inkjet ink, preferable a corporate spot color inkjet ink such as red colour inkjet ink of Coca-Cola™ and the blue colour inkjet inks of VISA™ or KLM™. In a preferred embodiment the inkjet ink comprises metallic particles or comprising inorganic particles such as a white inkjet ink.

In a preferred embodiment an inkjet ink contains one or more pigments selected from the group consisting of carbon black, C.I. Pigment Blue 15:3, C.I. Pigment Blue 15:4, C.I Pigment Yellow 150, C.I Pigment Yellow 151, C.I. Pigment Yellow 180, C.I. Pigment Yellow 74, C.I Pigment Red 254, C.I. Pigment Red 176, C.I. Pigment Red 122, and mixed crystals thereof.

Jetting Viscosity and Jetting Temperature

The jetting viscosity is measured by measuring the viscosity of the liquid at the jetting temperature.

The jetting viscosity may be measured with various types of viscometers such as a Brookfield DV-II+ viscometer at jetting temperature and at 12 rotations per minute (RPM) using a CPE 40 spindle which corresponds to a shear rate of 90 s−1 or with the HAAKE Rotovisco 1 Rheometer with sensor C60/1 Ti at a shear rate of 1000 s−1

In a preferred embodiment the jetting viscosity is from 10 mPa·s to 200 mPa·s more preferably from 25 mPa·s to 100 mPa·s and most preferably from 30 mPa·s to 70 mPa·s.

The jetting temperature may be measured with various types of thermometers.

The jetting temperature of jetted liquid is measured at the exit of a nozzle in the print head (305) while jetting or it may be measured by measuring the temperature of the liquid in the liquid channels or nozzle while jetting through the nozzle.

In a preferred embodiment the jetting temperature is from 10° C. to 100° C. more preferably from 20° C. to 60° C. and most preferably from 30° C. to 50° C.

REFERENCE SIGNS LIST

100 Vacuum support
102 Pattern
150 Vacuum belt
200 Vacuum chamber
300 Inkjet printing device
305 Print head
315 Dryer
350 Print head movement
500 Substrate
502 Image

The invention claimed is:

1. An inkjet printing method using an inkjet printing device including a vacuum support to hold a substrate on a support surface by air suction, the method comprising the steps of:

jetting a plurality of layers with a set of liquids on the support surface to define a pattern having a surface roughness between 2.0 μm and 200.0 μm and rougher than a surface roughness of the support surface; and supporting the substrate at least partially on the pattern; wherein the substrate is a heat-sensitive substrate which loses structural integrity above a temperature of 35° C.

2. The inkjet printing method according to claim 1, wherein the vacuum support includes a vacuum belt.

3. An inkjet printing method using an inkjet printing device including a vacuum support to hold a substrate on a support surface by air suction, the method comprising the steps of:

jetting a plurality of layers with a set of liquids on the support surface to define a pattern having a surface roughness between 2.0 μm and 200.0 μm and rougher than a surface roughness of the support surface; and supporting the substrate at least partially on the pattern; wherein the step of jetting the plurality of layers is performed while applying a vacuum suction with the vacuum support via a plurality of vacuum apertures.

4. The inkjet printing method according to claim 3, further comprising the steps of:

inkjet printing on the substrate; and after the step of inkjet printing on the substrate, removing the pattern from the vacuum support.

5. The inkjet printing method according to claim 4, wherein the step of removing the pattern includes:

wiping the pattern mechanically off the vacuum support; and/or wiping the pattern chemically off the vacuum support; and/or scratching the pattern off the vacuum support; and/or peeling the pattern off the vacuum support; and/or gumming the pattern off the vacuum support; and/or burning the pattern off the vacuum support.

6. The inkjet printing method according to claim 4, wherein the inkjet printing device includes a dryer and a set of inks, and the method further comprises the steps of:

drying the plurality of layers jetted on the support surface with the dryer;

after the step of supporting the substrate, jetting an image with the set of inks on the substrate; and drying the image with the dryer.

7. The inkjet printing method according to claim 6, wherein the set of liquids defines a portion of the set of inks.

8. The inkjet printing method according to claim 7, wherein a jetting viscosity of the set of liquids and/or the set of inks is between 25 mPa·s and 300 mPa·s.

9. The inkjet printing method according to claim 3, wherein the plurality of layers is at least 2.

10. The inkjet printing method according to claim 3, wherein the pattern includes a plurality of dried-and-jetted clusters and each of the plurality of dried-and-jetted clusters is formed by jetting and drying a plurality of droplets of the set of liquids; and each of the plurality of dried-and-jetted clusters has a surface area between 400 $\mu m^2$ and 100,000,000 $\mu m^2$.

11. The inkjet printing method according to claim 3, wherein the pattern includes a lattice pattern having a thickness between 5 μm and 300 μm, or a pseudo-random pattern having a thickness between 5 μm and 300 μm.

12. The inkjet printing method according to claim 3, wherein the pattern includes a dimple pattern.

13. The inkjet printing method according to claim 12, wherein the dimple pattern has a dimple perimeter that defines a circle, ellipse, oval, triangle, square, rectangle, pentagon, hexagon, heptagon, octagon, rhombus, rectangle, regular polygon, or any polygon including at least three sides.

14. The inkjet printing method according to claim 3, wherein the inkjet printing device includes a gantry coupled to a print head, and the method further comprises the step of:

moving the vacuum support, parallel to a plane of the support surface, linearly and relatively to the gantry underneath the print head in a first direction to position the print head above the substrate and the support surface.

15. The inkjet printing method according to claim 14, further comprising the step of:

moving the print head, parallel to the plane of the support surface, from the vacuum support and perpendicular to the first direction, linearly along the gantry and jetting on the substrate or on the support surface.

16. The inkjet printing method according to claim 3, wherein the substrate includes a woven or non-woven textile, leather, plastic foil, or paper which is impregnated with a thermosetting resin.

* * * * *